United States Patent [19]

Buholtz et al.

[11] 4,318,606

[45] Mar. 9, 1982

[54] MAGNETIC TONER IMAGING-MULTIPLEXING APPARATUS

[75] Inventors: William F. Buholtz; Timothy R. Geis, both of Longwood, Fla.

[73] Assignee: Burroughs Corporation, Orlando, Fla.

[21] Appl. No.: 113,670

[22] Filed: Jan. 21, 1980

[51] Int. Cl.[3] ..... G03G 15/00

[52] U.S. Cl. ..... 355/3 DD; 118/657; 118/658

[58] Field of Search ..... 355/3 R, 3 DD; 118/653, 118/656, 657, 658, 661

[56] References Cited

U.S. PATENT DOCUMENTS

| | | | |
|---|---|---|---|
| 3,152,924 | 10/1964 | Wanielista et al. | 118/657 X |
| 3,233,587 | 2/1966 | Morton | 118/657 |
| 3,392,432 | 7/1968 | Naumann | 118/657 X |
| 3,865,080 | 2/1975 | Hudson | 118/657 X |
| 3,879,737 | 4/1975 | Lunde | 118/657 X |
| 3,914,771 | 10/1975 | Lunde et al. | 118/657 X |
| 4,139,296 | 2/1979 | Ruckdeschel | 355/3 DD |
| 4,171,900 | 10/1979 | Brugger et al. | 118/657 X |
| 4,218,691 | 8/1980 | Fujii | 118/657 X |

*Primary Examiner*—Fred L. Braun

*Attorney, Agent, or Firm*—Carl Fissell, Jr.; Kevin R. Peterson

[57] ABSTRACT

The present invention relates to magnetic toner imaging-multiplexing techniques and apparatus wherein the number of required voltage drivers is substantially reduced. The apparatus includes a multi-pole magnet assembly surrounded by a shell-like member operatively coupled to a drive motor for creating relative motion between said magnet assembly and said shell-like member. A multiplicity of helical, highly permeable electrodes are circularly disposed around the periphery of the shell member with electrical connections to external voltage drivers through a slip-ring assembly. Magnetic imaging toner is circulated across the toner electrodes as a result of the relative motion between the shell and the magnet assembly. Field concentrating apparatus is disposed within the shell adjacent to a dielectric drum on which the intelligible image is to be produced. As the toner is circulated across the shell, a toner tree or brushlike pile of toner is formed at points where the toner electrodes intersect the magnetic field from the concentrating apparatus and the dielectric drum. Dots of toner are deposited on the drum at these points when the electrodes are driven to a suitable electrical potential. A modification of this apparatus incorporates a plurality of magnetic wire pins arranged parallel to the axis of the shell in diagonal arrays there across. Field concentrating members extend parallel to the shell axis and cause toner trees or brushes to be generated at the line of pins normal to the magnet pole faces as the magnet assembly is moved relative to the shell.

16 Claims, 10 Drawing Figures

MAGNETIC TONER IMAGING-MULTIPLEXING APPARATUS

BACKGROUND OF THE INVENTION

1. Field of the Invention

The present invention relates to magnetic toner imaging apparatus and more particularly to rotating field magnetic toner imaging apparatus wherein rotating field imaging is utilized and incorporates means for causing magnetic toner to be moved over the surface of a carrier member for deposition onto a dielectric surface member at the point of magnetic flux concentration thereof.

2. Description of the Prior Art

The apparatus described in the present specification is considered to be an improvement over that described in the Kotz U.S. Pat. No. 3,816,840. Kotz describes a technique by which single component, conductive and magnetic toner is selectively deposited onto a dielectric drum or surface by a single row pin array assembly. The Kotz arrangement thus requires a single conductor and voltage driver for each pin. The techniques and apparatus described in the present application provide means for significantly reducing the required number of drivers and electrical interconnections and pins.

SUMMARY OF THE INVENTION

The present invention relates to a magnetic toner imaging device wherein a stationary multipole magnet, with a field concentrator bar attached, is surrounded by a rotating shell with a multiplicity of highly permeable toner electrodes. The electrodes are arranged in a helical, single or fractional revolution pattern around the shell with electrical connections to external voltage drivers through a slip-ring assembly. Magnetic toner is circulated across the toner electrodes by the relative rotative motion between the shell and the magnet assembly. A toner tree or brush is produced at points where toner electrodes intersect the field from the toner concentrator bar. A dielectric drum, adjacent to the rotating shell at the point of the concentrator bar, receives dots of toner at these points when the toner electrodes are driven to a suitable electrical potential.

In another embodiment of the present invention a rotating multipole magnet is surrounded by a counter-rotating shell with a multiplicity of highly permeable toner electrodes. The electrode arrangement and operation are similar to that in the first mentioned apparatus. Field concentrating pole pieces may be required to assure desired resolution. Such concentrating pole pieces would be attached to each pole on the rotating magnet assembly. Alternatively, a single concentrator bar could be mounted in a stationary position between the rotating magnet and the rotating shell at the line of adjacency between the rotating shell and the electrostatic drum.

A further modification of the subject invention incorporates a stationary magnet bar with a conentrated field mounted in a stationary position inside a rotating shell. Secured helically onto the outer surface of the shell are a multiplicity of toner electrodes, each radially magnetized to provide alternate poles respectively, top and bottom. A toner station, mounted before the imaging station, deposits toner in a continuous stream on the toner electrodes. The concentrator magnet forms a toner tree or brush at the line of adjacency between the rotating shell and the dielectric drum. Electrical potential applied to the toner electrodes causes toner dots to be deposited on the dielectric drum at the points of intersection between driver electrodes and the concentrator bar.

A still further embodiment of the present invention comprises a magnetic-imaging head constructed of a number of sets of magnetic wire pins arranged in diagonal arrays across the head. All the pins in a given diagonal row in the array are electrically interconnected and driven by a single voltage driver. The head assembly is permanently mounted on a stationary shell. The shell houses a rotating multi-pole magnet, with each pole having a field concentrator at its pole face. Toner is transported around the shell by the rotation of the magnet assembly. At the head, a toner brush or tree is generated at each of the parallel pin set elements sequentially as the pole piece traverses the head concentrated field lines cause the toner brush or tree to be at a maximum for only one parallel pin row at a time to allow a number of dot rows/columns to be imaged by the same voltage driver during the same pole face pass.

DETAILED DESCRIPTION OF A PREFERRED EMBODIMENT OF THE INVENTION

Figure 1:
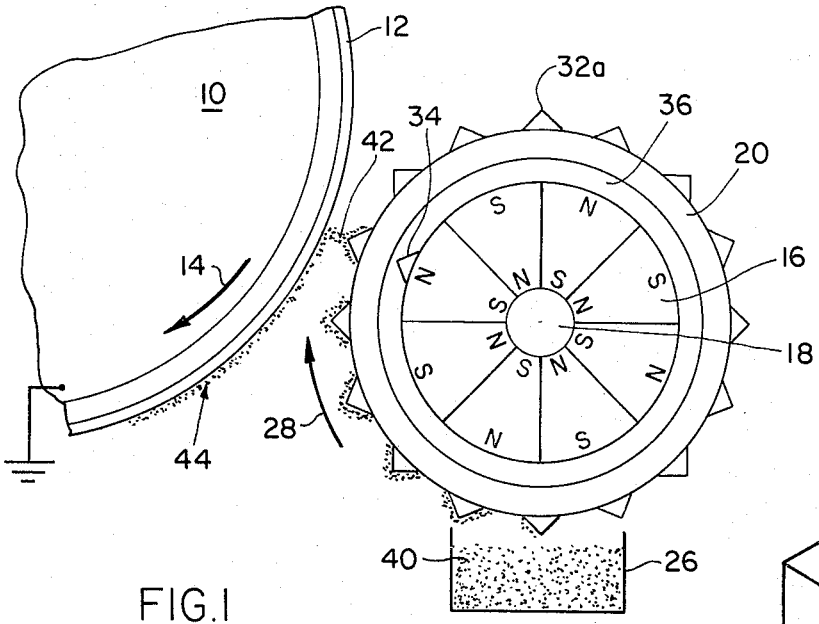
FIG. 1 is an end elevational view of apparatus embodying the present invention.
Figure 2:
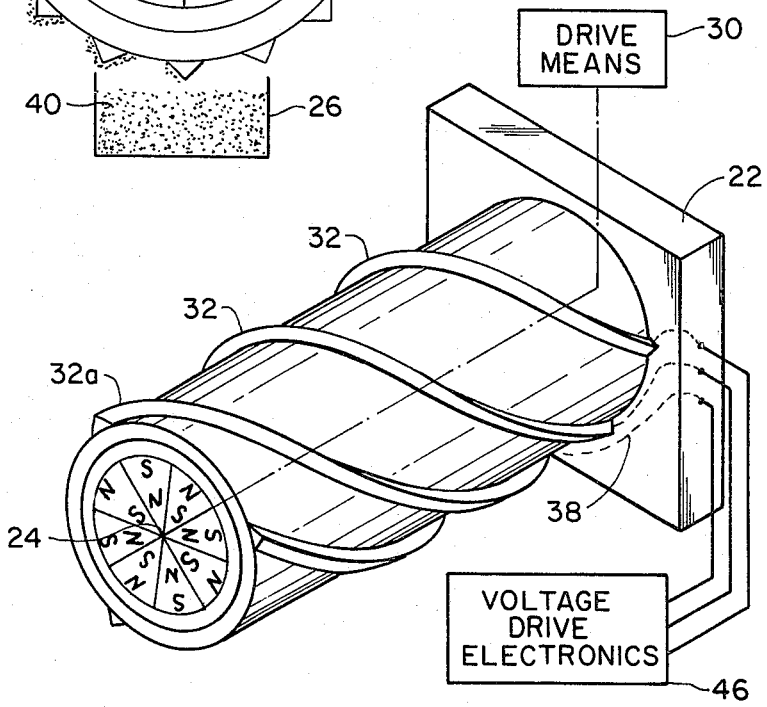
FIG. 2 is an isometric view of the construction and apparatus of FIG. 1 illustrating the helical electrode construction on the exterior of the shell member.

As seen most clearly in FIGS. 1 and 2 of the drawing, a conductive drum 10, of aluminum or similar non-magnetic material, is provided with a uniform dielectric surface coating 12 thereon and is supported for rotative movement in the direction of arrow 14, in a known manner. Closely adjacent to the drum 10 is a multi-pole magnet assembly 16 arranged with the narrow portion of each wedge or pie-slice section of the magnet oriented toward a support 18 which may be a circular shaft. The magnet assembly 16 in the embodiment of FIG. 1 is supported by means (not shown) in a fixed position.

A cylindrical, shell-like member 20 is arranged to surround the magnet assembly 16 axially thereof and in spaced apart relation to the magnet assembly 16. The shell member 20 is supported for rotation at both ends of which only one end is shown in FIG. 2, as housing 22, and extends outwardly away therefrom with the rotational axis 24 parallel to a toner supply 26. The shell is rotated in the direction of arrow 28 by drive means 30.

A plurality of highly permeable toner electrode members 32 are arranged in a helical, single or fractional revolution pattern around the external periphery of shell 20 (FIG. 2). Each helical member 32 is angularly shaped, triangular in the embodiment of FIG. 1 with the sharp edge apex portion 32*a* thereof oriented outwardly away from the surface of shell 20.

A magnetic field flux line concentrator member 34, FIG. 1, in the form of an elongated, triangular bar, co-extensive with shell 20, is disposed in the space 36 between the inner surface of shell 20 and the outer surface of magnetic assembly 16. Each of the helical electrodes 32 is electrically connected as shown to a slip-ring assembly 38, not otherwise identified, for energizing each electrode as desired and as explained later on herein.

In operation of the apparatus, drum 10 is rotated in the direction of arrow 14 conjointly with shell member 20 by means of drive means 30. As each helical electrode 32 passes through the toner supply 26, the relative rotative motion between shell 20 and magnet assembly 16 causes toner 40 to be circulated across each electrode and across the surface of the shell 20. A toner brush or tree formation 42 is formed at points where the apex edge of the electrodes 32 intersect the field from the magnet assembly 16 and the toner concentrator bar 34. The dielectric surface drum 10 adjacent to the rotating shell receives dots of toner 40 in the form of a pattern 44 of desired intelligence at these points in response to the application of suitable electrical potential pulses from the driver electronics 46. Obviously, since only a relatively small number of electrodes are required for operation of the present invention the required number of voltage drivers is significantly reduced.

Figure 3:
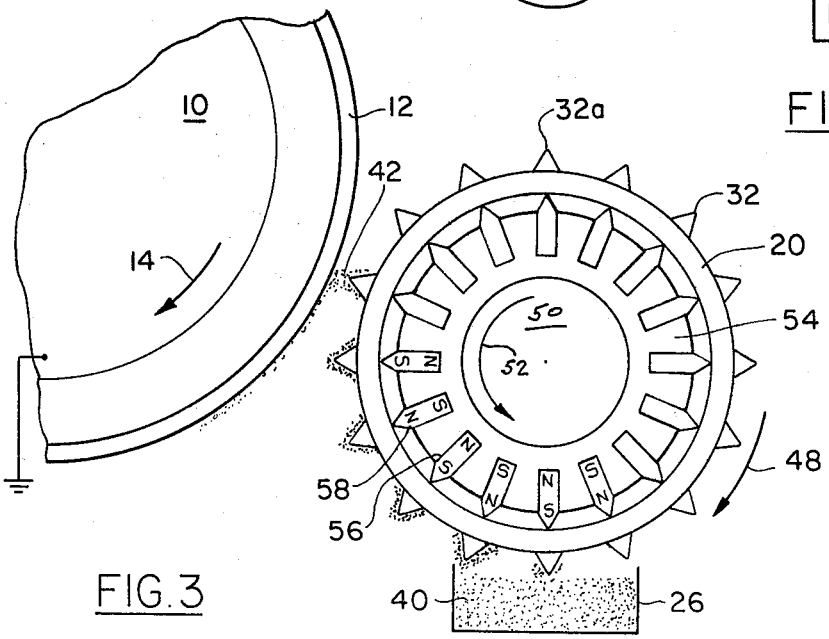
FIG. 3 is an end elevational view of a further embodiment of the present invention.

In a modified embodiment of the present invention as seen most clearly in FIG. 3, a conductive drum 10 having a dielectric surface 12 is rotated by means (not shown) similar to that discussed with respect to the apparatus of FIG. 1, in the direction of arrow 14.

A cylindrical, shell member 20 is arranged as in FIG. 1 for horizontal rotative movement by drive means 30 and carries on its peripheral exterior surface a plurality of triangular helical electrodes 32. Shell 20 is rotated in the direction of arrow 48 through toner supply 26 by drive means 30 similar to that of FIG. 1.

Disposed on shaft 50 for rotation in the direction of arrow 52 by suitable means (not shown) is a multi-pole magnet assembly 54. Magnet assembly 54 comprises a multiplicity of individual magnet members 56 with alternate N and S magnet poles 58 oriented as shown. Magnet assembly 54 is rotated counter-clockwise while the shell assembly 20 is rotated clockwise. Electrode arrangement and operation is substantially identical to that of the apparatus described in connection with FIG. 1. Field concentrating pole pieces, if required to provide adequate resolution, can be attached to each pole 58 on the rotating magnet assembly 54. Alternatively, a single concentrator bar could be mounted in a stationary position between the rotating magnet assembly 54 and the contra-rotating shell 20 at the line of adjacency between the shell 20 and the dielectric drum 10.

Figure 4:
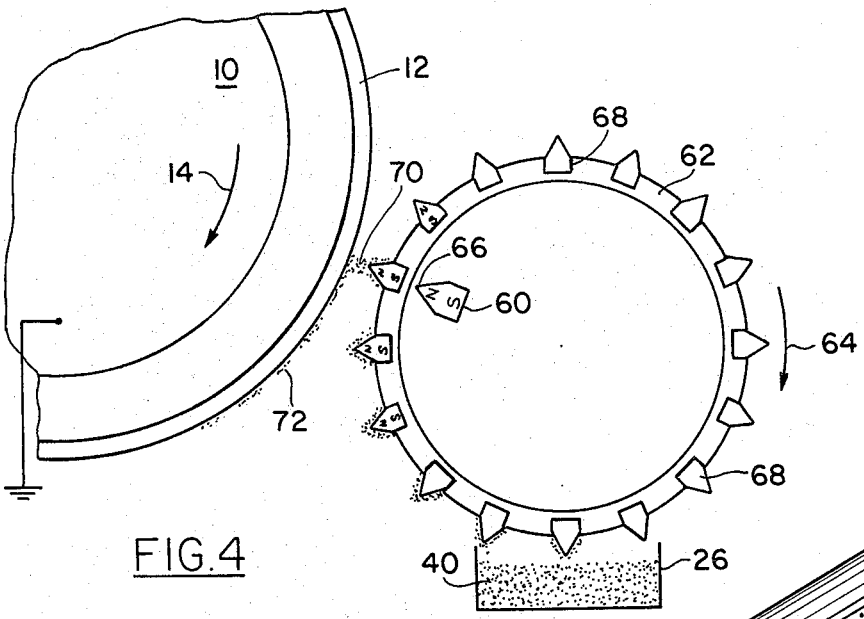
FIG. 4 is an end elevational view of a still further embodiment of the present invention.

In the illustrative embodiment of FIG. 4, a stationary bar magnet 60 is mounted within the cylindrical shell 62 for rotation clockwise, (by means similar to that shown and described in connection with FIG. 1) in the direction of arrow 64. Magnet 60 is triangularly shaped with its apex 66 of the pole face oriented perpendicular to the axis of rotation of shell 62. Mounted helically on the external periphery of shell 62 are a plurality of toner electrodes 68. Each electrode 68 is radially magnetized as seen in FIG. 4 with the external angularly shaped pole face oriented outwardly away from the shell surface.

Toner 40 from supply 26 mounted ahead of the imaging area on drum 10, is picked up by the electrodes 68 of rotating shell 62 and is deposited in a continuous stream on electrodes 68 of shell 62. Concentrator magnet 60 forms a toner brush or tree 70, at the line of adjacency between the rotating shell and the contrarotating drum 10. Electrical potentials applied to the toner electrodes 68 in selective fashion cause toner dots 72 to be deposited on dielectric drum 10 at the points of intersection between a driven electrode 68 and the concentrator bar 60. The dots 72 form patterns of intelligence as desired.

Figure 5A:
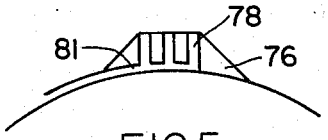
FIG. 5*a* is a partial sectional view of an end portion of the apparatus of FIG. 5.
Figure 5B:
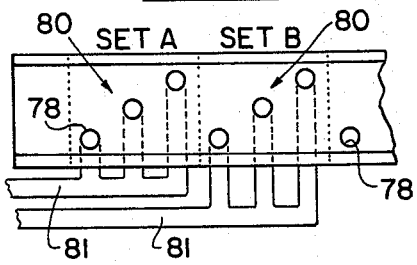
FIG. 5*b* is an enlarged top plan view of a portion of the pin head structure of FIG. 5 illustrating the pin electrode interconnect scheme.
Figure 5C:
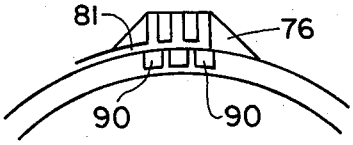
FIG. 5*c* is a view similar to FIG. 5*a* but illustrating field concentrator bars for each row of pin electrodes.
Figure 5D:
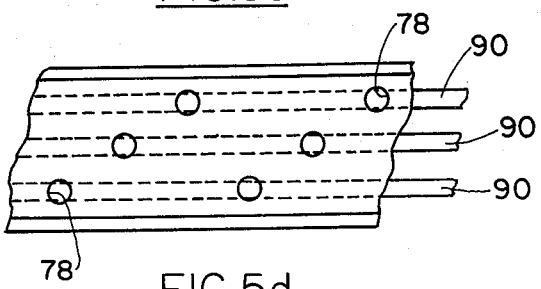
FIG. 5*d* is a top plan view greatly enlarged of a portion of the pin head structure illustrating the "set" configuration of pin electrodes with field concentrator bars therebelow for the apparatus of FIG. 5.
Figure 5:
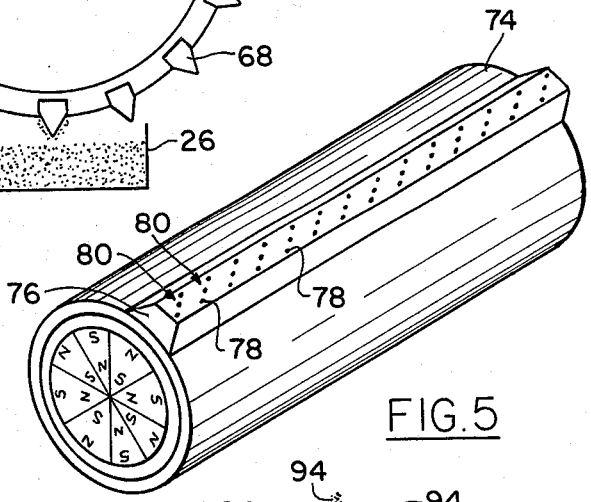
FIG. 5 is an isometric view of an embodiment of the shell construction utilizing a multi-pin array assembly.
Figure 6:
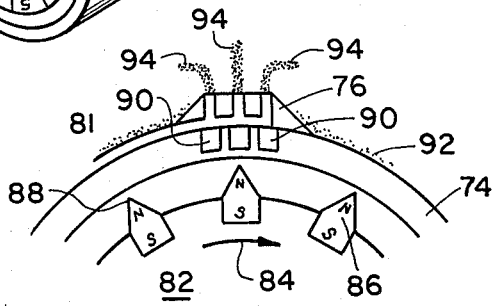
FIG. 6 is an end elevational view of a portion of the apparatus of FIG. 5 illustrating an arrangement combining a rotating magnet assembly with internal pole face concentrators and stationary concentrator bars.

A slightly different embodiment from the apparatus of FIGS. 1 through 4 inclusive is illustrated in FIGS. 5 and 6. A non-conductive, non-rotating shell 74, FIG. 5, is provided with a raised imaging head with dielectric support 76 secured as by adhesives to shell 74. The imaging head member extends axially along the surface of the shell. A plurality of sets of magnetically permeable electrically conductive pins 78 are arranged in the head 76 in repeating diagonal arrays 80, three pins per set in the embodiment shown. All of the pins 78 of each row are electrically interconnected by means of conductors 81 as seen in the plane view of FIG. 5*b* and the end view of FIGS. 5*a*, 5*c* and FIG. 6, and are driven by a single voltage driver (not shown). The shell 74 houses a rotatable, multi-pole magnet assembly 82 rotated by means (not shown) in the direction of arrow 84, FIG. 6, with each magnet pole having a tapered pole face 88. An individual field concentrator bar 90 co-extensive and parallel with shell 74 extends beneath each pin electrode array row.

As the magnet assembly 82 is rotated by means (not shown) in the direction of arrow 84, toner 92, from a source (not shown) is transported around the shell 74 by the rotation of the magnet assembly 82 relative to shell 72. At the head 76 formed by the pin arrays, a toner tree or brush 94 is generated at each of the parallel pin set elements sequentially as the pole piece traverses the head 76.

As seen in FIG. 6, concentrated field lines (not shown) cause the toner tree or brush 94 to be at maximum for only one parallel row of pins at a time. This permits a number of dot rows/columns to be imaged on an associated dielectric drum member (not shown) by the same driver during the same pole pass.

Thus the apparatus just described reduces to a bare minimum the number of voltage drivers required to apply electrical potential to the pin electrode assembly for imaging intelligence on the dielectric drum 10. In addition this arrangement permits multiplexing of data by means of the pin position and signal application as shown particularly FIGS. 5 and 6.

What is claimed is:

1. Magnetic-conductive toner image-multiplexing apparatus comprising:

rotatable, non-conductive, hollow, cylindrical means disposed adjacent a magnetic-conductive toner supply, magnetic assembly means disposed within said cylindrical means axially thereof, magnetic field concentrating means disposed within said cylindrical means effective to concentrate magnetic flux from said magnetic assembly means normal to the axis of rotation of said cylindrical means, helical means surrounding said cylindrical means operable upon rotation of said cylindrical means to cause toner from said supply to be threaded along said helical means, and electrical circuit means operably connected to said helical means for applying suitable electrical potentials to said helical means effective to further amplify the magnetic flux generated by said magnetic assembly means and to cause said toner to vertically bunch together adjacent to said field concentrating means for deposition onto an operably associated dielectric surface.

2. The invention in accordance with claim 1, wherein said non-conductive, hollow, rotatable, cylindrical means comprises a dielectric member rotatably secured to an electrically insulating support so that the cylindrical means extends horizontally, outwardly away therefrom.

3. The invention in accordance with claim 1, wherein said magnetic assembly means further comprises a plurality of individual magnet members arranged accurately around a central axial support for relative movement between said cylindrical means and said magnetic assembly means.

4. The invention in accordance with claim 1, wherein said magnetic field concentrating means further comprises a fixed permanent magnet member secured to said hollow cylindrical means and extending parallel to the axis of rotation thereof.

5. The invention in accordance with claim 4, wherein said fixed permanent magnet is physically tapered from its base to its apex with the apex of taper normal to the axis of rotation of said cylindrical means.

6. The invention in accordance with claim 1, wherein said magnetic field concentrating means is fixed to and movable with said movable cylindrical means.

7. The invention in accordance with claim 1, wherein said helical means further comprises a plurality of elongated, highly permeable members secured in spaced apart, spiral, single or fractional revolution fashion around the external periphery of said cylindrical means.

8. The invention in accordance with claim 1, wherein said means for applying electrical potentials to said helical means further comprises an electrical slip-ring assembly operably electrically connected to the individual elements of said helical means.

9. The invention in accordance with claim 8, wherein the individual helices of said helical means comprise soft iron members and wherein each such member is tapered from a base portion of substantial size to a relatively sharp edge.

10. Magnetic-conductive toner image-multiplexing apparatus comprising:

rotatable, non-conductive, hollow, cylindrical means disposed adjacent to a magnetic-conductive toner supply, helical means surrounding said cylindrical means operable upon rotation of said cylindrical means to cause toner from said supply to circulate across the surface of said helical means, contra-rotatable magnet assembly means, each magnet of said assembly means having a tapered pole face oriented normal to said helical means, magnetic field concentrating means operably associated with respective pole faces, and electrical circuit means operably connected to said helical means for applying suitable electrical potentials to said helical means effective to selectively apply electrostatic force to thereby oppose the magnetic attraction generated by said magnet assembly to allow deposition onto an operably associated dielectric surface.

11. The invention in accordance with claim 10, wherein said magnet assembly further comprises a plurality of individual magnet members circularly disposed about a common center and having the external pole face of each magnet tapered toward the exterior periphery of said cylindrical means.

12. The invention in accordance with claim 1, wherein said field concentrating means comprises an elongated bar of highly permeable material disposed in a stationary position between the rotating magnet assembly and said cylindrical means at the line of adjacency between the cylindrical means and the surface of the associated dielectric surface.

13. The invention in accordance with claim 12, wherein said helical means further comprises individual magnet members, the external portion of each one of which is outwardly tapered and wherein a stationary concentrator magnet member is disposed within the cylindrical means effective to cause the toner to form into a vertically oriented column or tree at the line of adjacency between the rotating cylindrical member and the operably associated dielectric surface.

14. Magnetic-conductive toner image-multiplexing apparatus comprising:

non-conductive, hollow, cylindrical means having a magnetic imaging head thereon, said imaging head including a plurality of individual magnetic members arranged in repeating, non-overlapping, diagonal arrays with the magnetic members of each array electrically interconnected such that each array may be energized by a separate source of electrical potential, a rotatable multi-pole magnet assembly disposed within said hollow cylindrical means, magnetic field concentrator means disposed at each pole face of said magnet assembly, and means for rotating said magnet assembly so that rotation of said assembly past a toner supply causes the toner to be transported across the cylindrical means due to the circular movement of the magnet assembly whereby a vertical column of toner is produced at each parallel array sequentially as the magnetic poles of the magnet assembly traverse the head.

15. The invention in accordance with claim 14, wherein said magnetic members of said imaging head further comprise elongated, magnetizable pins and wherein said pins are disposed within a dielectric, truncated, wedge-like member, said wedge-like member being attached to and forming a part of said cylindrical means.

16. The invention in accordance with claim 14 wherein said field concentrator means further comprise a plurality of elongated bars of highly permeable material disposed beneath said imaging head and axially aligned with separate rows of said array, said bars being secured to the inner periphery of the cylindrical means.

* * * * *